US010612226B2

(12) United States Patent
Hurd et al.

(10) Patent No.: US 10,612,226 B2
(45) Date of Patent: Apr. 7, 2020

(54) SPLASH PREVENTION APPARATUS

(71) Applicants: Randy C. Hurd, Orem, UT (US); Tadd T. Truscott, Logan, UT (US); Zhao Pan, Hohhot (CN); Andrew S. Merritt, Logan, UT (US)

(72) Inventors: Randy C. Hurd, Orem, UT (US); Tadd T. Truscott, Logan, UT (US); Zhao Pan, Hohhot (CN); Andrew S. Merritt, Logan, UT (US)

(73) Assignee: Utah State University

( * ) Notice: Subject to any disclaimer, the term of this patent is extended or adjusted under 35 U.S.C. 154(b) by 0 days.

(21) Appl. No.: 15/703,184

(22) Filed: Sep. 13, 2017

(65) Prior Publication Data

US 2018/0080210 A1 Mar. 22, 2018

Related U.S. Application Data

(60) Provisional application No. 62/395,881, filed on Sep. 16, 2016.

(51) Int. Cl.
*E03D 13/00* (2006.01)

(52) U.S. Cl.
CPC ..... *E03D 13/005* (2013.01)

(58) Field of Classification Search
CPC .... E03D 13/005; E03D 13/007; A01K 1/0107
USPC ..... 3/300.3; 119/621, 622; 15/142, 186–188
See application file for complete search history.

(56) References Cited

U.S. PATENT DOCUMENTS

| | | | | |
|---|---|---|---|---|
| 4,671,976 | A * | 6/1987 | Vidal | A47K 1/14 4/286 |
| 5,313,672 | A | 5/1994 | Luedtke et al. | |
| 5,774,905 | A | 7/1998 | Wager et al. | |
| 6,076,222 | A * | 6/2000 | Jolly | A63B 57/60 15/161 |
| D520,610 | S | 5/2006 | Wrate | |
| 7,398,565 | B1 | 7/2008 | Chou | |
| D639,410 | S | 6/2011 | Ramirez | |
| D678,482 | S | 3/2013 | Williams | |

(Continued)

OTHER PUBLICATIONS

Hurd et al., Abstract: Creating a Urine Black Hole, 68th Annual Meeting of the APS Division of Fluid Dynamics, Oct. 5, 2015, published online: http://meetings.aps.org/Meeting/DFD15/Session/M32.10.

(Continued)

*Primary Examiner* — Janie M Loeppke

(57) ABSTRACT

A splash prevention apparatus is disclosed. The splash prevention apparatus may be placed on a surface to capture satellite droplets that would result from a liquid impinging upon the surface. The splash prevention device is designed to be particularly effective when used inside a urinal to capture impinging urine. In embodiments, a splash prevention device includes a planar base pad, which may be designed to either fit the shape of the base of a urinal or to resemble other easily recognizable shapes. In embodiments, a pillar array extends from the planar base pad and the pillars may be made of a material that will bend when impinged upon by a stream of urine. Both the base pad and pillar array of a splash prevention device may be formed from rigid or deformable material. The pillar array may be arranged in a Cartesian or non-Cartesian pattern.

12 Claims, 12 Drawing Sheets

(56) References Cited

U.S. PATENT DOCUMENTS

| | | | | |
|---|---|---|---|---|
| 8,856,977 | B2 | 10/2014 | Ramirez | |
| 10,036,154 | B2 * | 7/2018 | Crevier | E03D 13/005 |
| 2005/0144711 | A1 * | 7/2005 | Valadez | E03D 13/00 4/309 |
| 2007/0266486 | A1 * | 11/2007 | Ramirez | E03D 13/00 4/309 |
| 2013/0298840 | A1 * | 11/2013 | Mishan | A01K 1/0107 119/165 |
| 2014/0075663 | A1 | 3/2014 | Irwin et al. | |
| 2014/0157501 | A1 | 6/2014 | D'Amico | |
| 2014/0259344 | A1 * | 9/2014 | Muderlak | E03D 13/005 4/256.1 |
| 2014/0261223 | A1 * | 9/2014 | Gee | A01K 13/004 119/621 |
| 2015/0047114 | A1 | 2/2015 | Ramirez | |
| 2015/0211221 | A1 | 7/2015 | Tarabay | |
| 2016/0215490 | A1 * | 7/2016 | Keune | E03D 13/005 |
| 2017/0096808 | A1 * | 4/2017 | D'Amico | E03D 13/005 |

OTHER PUBLICATIONS

Hurd et al., Creating a Urine Black Hole, 68th Annual Meeting of the APS Division of Fluid Dynamics, Nov. 22, 2015, Boston, MA.

* cited by examiner

SPLASH PREVENTION APPARATUS

RELATED APPLICATIONS

This patent application claims the benefit of U.S. Provisional Application 62/395,881, filed Sep. 16, 2016 and entitled SPLASH PREVENTION APPARATUS, which is incorporated herein by reference in its entirety.

TECHNICAL FIELD

The present disclosure relates to splash prevention devices inserted into urinals, more particularly, embodiments that are designed to attenuate the amount of reflective splash from an incoming urine stream.

BACKGROUND

Urinals in men's restrooms pose a health risk. While using a urinal the male's urine stream often creates splash-back spreading urine droplets on the user and his surroundings. Pasteur (1863) observed that human urine will readily support bacterial growth. The urine that has escaped the urinal can be tracked elsewhere, cause corrosion on features surrounding the urinal, creates a pungent odor in the bathroom, and often leads to embarrassment to the user when small wet spots created from the splash-back can clearly be seen on the user's clothing. The inventors of the current disclosure performed experiments to create a device that can be inserted into a urinal to prevent splash-back.

From experiments performed by the inventors of the current disclosure using an artificial male urethra and urine stream, it was observed that the liquid stream breaks into individual droplets due to the Plateau-Rayleigh instability as can be seen in FIG. 1. Previous laboratory work also showed that the splash caused by an impinging stream is nearly negligible, but that undesired splash-back is generated when droplet impact occurs. Thus the problem is simplified to a droplet impact incident. Splash-back occurs due to droplet impact onto a liquid film. Even if the surface is initially dry, the first impacting droplet effectively spreads to create a thin liquid film. When a droplet impacts a thin liquid film it forms a splash crown which rapidly expands outward from the point of impact as can be seen in FIG. 2. As this cylindrical sheet of fluid expands outward, a fluid instability on the top edge leads to the formation of satellite droplets 180 which are ejected during a splash event.

SUMMARY

The inventors of the present disclosure identified that in order to prevent the trajectory of these satellite droplets 180, a structure must be created to either prevent the satellite droplets 180 from forming or intercept them after formation. The present disclosure in aspects and embodiments addresses these various needs and problems by providing a splash prevention apparatus. A splash prevention apparatus generally consists of a pillar array extending vertically from a planar base pad. This splash prevention apparatus may be placed in a urinal for the purpose of capturing satellite droplets 180.

DETAILED DESCRIPTION

Figure 1:
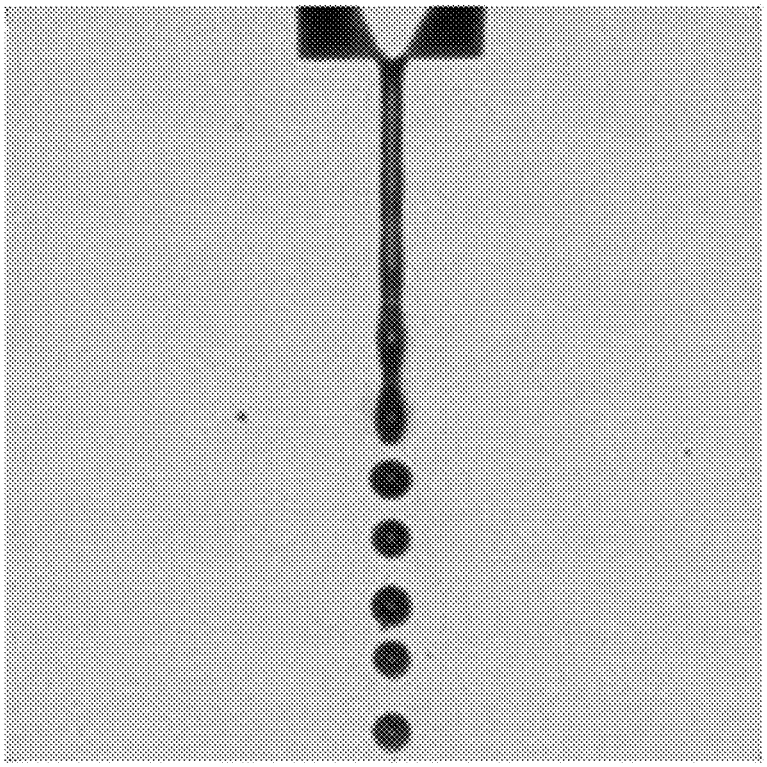
FIG. 1 (Prior Art)
FIG. 1 is a depiction of the Plateau-Rayleigh instability.

The present disclosure covers apparatuses and associated methods for a splash prevention device. In the following description, numerous specific details are provided for a thorough understanding of specific preferred embodiments. However, those skilled in the art will recognize that embodiments can be practiced without one or more of the specific details, or with other methods, components, materials, etc. In some cases, well-known structures, materials, or operations are not shown or described in detail in order to avoid obscuring aspects of the preferred embodiments. Furthermore, the described features, structures, or characteristics may be combined in any suitable manner in a variety of alternative embodiments. Thus, the following more detailed description of the embodiments of the present invention, as illustrated in some aspects in the drawings, is not intended to limit the scope of the invention, but is merely representative of the various embodiments of the invention.

In this specification and the claims that follow, singular forms such as "a," "an," and "the" include plural forms unless the content clearly dictates otherwise. All ranges disclosed herein include, unless specifically indicated, all endpoints and intermediate values. In addition, "optional", "optionally" or "or" refer, for example, to instances in which subsequently described circumstance may or may not occur, and include instances in which the circumstance occurs and instances in which the circumstance does not occur. The terms "one or more" and "at least one" refer, for example, to instances in which one of the subsequently described circumstances occurs, and to instances in which more than one of the subsequently described circumstances occurs.

Figure 2:
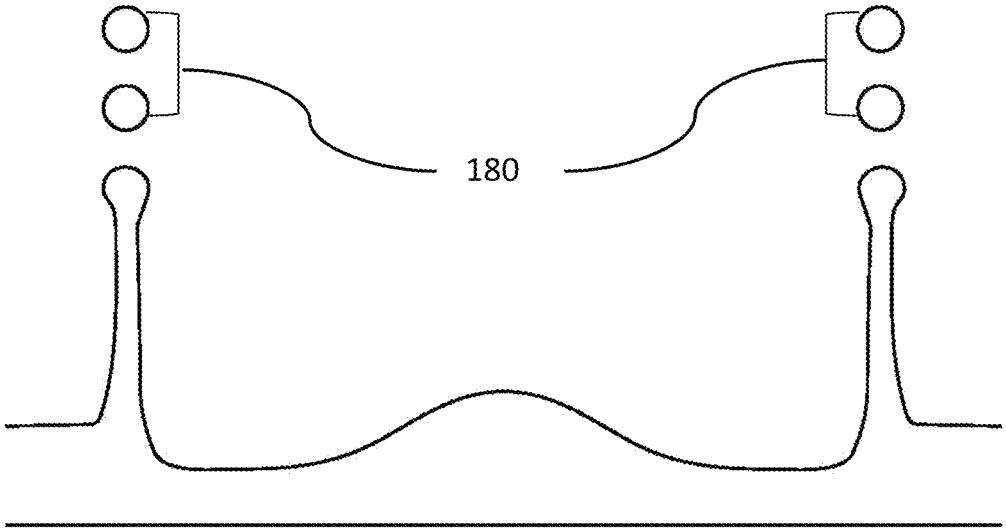
FIG. 2 (Prior Art)
FIG. 2 is a diagram of a splash crown.
Figure 3A:
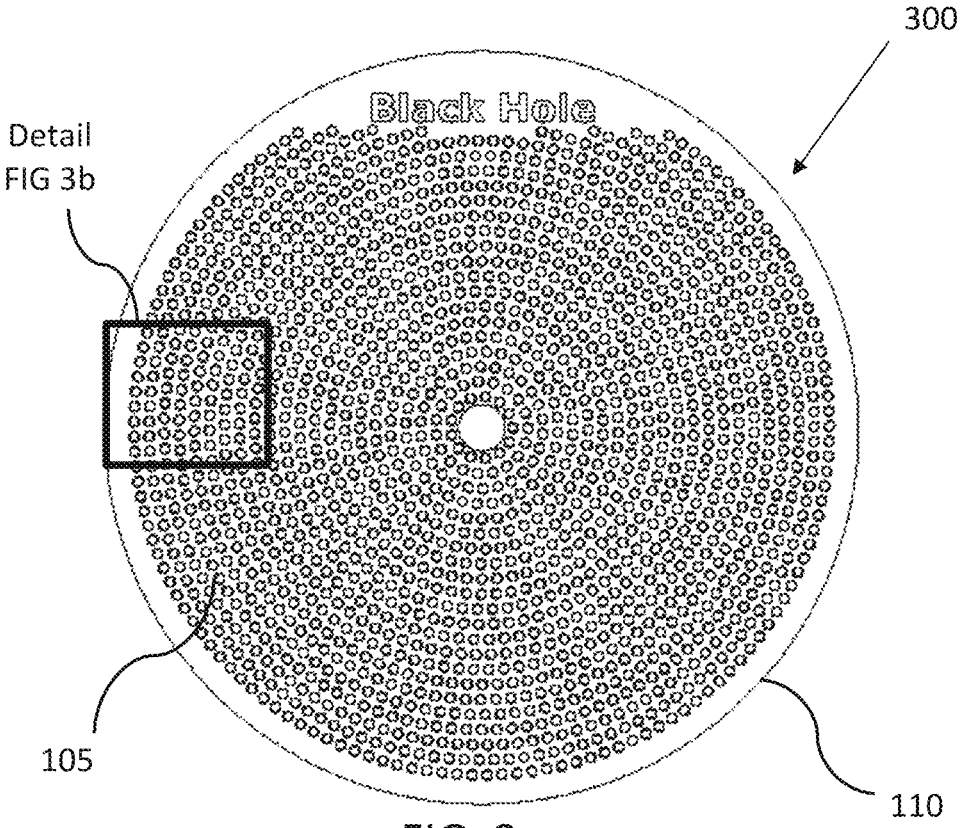
FIG. 3*a* is a top view of a splash prevention device.
Figure 3B:
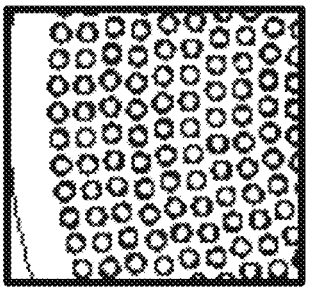
FIG. 3*b* is an expanded view of a pillar array pattern.
Figure 4:
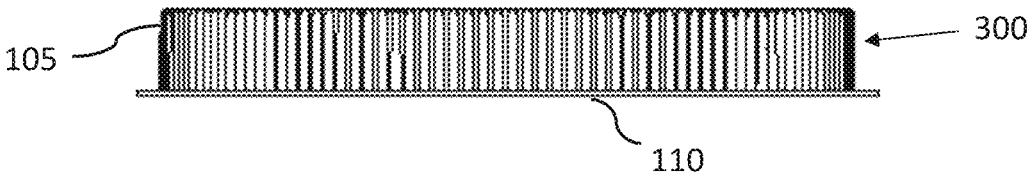
FIG. 4 is a side view of the splash prevention device of FIG. 3.

FIGS. 3*a* through 9 illustrate various splash prevention devices. In FIGS. 3*a*, 3*b*, and 4, a splash prevention apparatus 300 is placed on a surface to capture satellite droplets 180 (shown in FIG. 2) that would result from a liquid impinging upon the surface. This is especially desirable when the liquid could be harmful to surrounding objects and people. The splash prevention device 300 is designed to be particularly effective when used inside a urinal to capture impinging urine. In embodiments, a splash prevention device 300 includes a planar base pad 110. The planar base pad 110 may be any two or three-dimensional shape. For example, the base pad may be flat or spherical (See FIGS. 8 and 9). The planar base pad 110 is often designed to either fit the shape of the base of a urinal or to resemble other easily recognizable shapes and objects like circles, ovals, squares, etc. In embodiments, a pillar array 105 extends from the planar base pad 110 which includes multiple pillars. In embodiments, the pillars 110 are made of a material that will bend when impinged upon by a stream of urine. Both the base pad 110 and pillar array 105 of a splash prevention device may be formed from rigid or deformable material. A pillar array 110 may be arranged in a Cartesian or non-Cartesian pattern. A pillar array 110 may be created in manner such that each pillar is set at a non-perpendicular angle 130 (See FIG. 7). Pads may be coated or infused with chemicals designed to eliminate odor or emit a pleasant fragrance. Pads may also be coated in a surfactant which, when impinged upon by a liquid, helps to create foam and bubbles. This foam would aid in the capture of satellite droplets 180.

The following examples are illustrative only and are not intended to limit the disclosure in any way.

EXAMPLES

FIG. 3*a* illustrates a representative embodiment of a splash prevention apparatus 300. A splash prevention device 300 is placed on a surface to capture satellite droplets 180 that would result from a liquid impinging upon said surface. This is especially desirable when the liquid could be harmful to surrounding objects or people. The splash prevention device 300 is designed to be particularly effective when used inside a urinal to capture impinging urine. In embodiments, a splash prevention device 300 includes a planar base pad 110. A planar base pad 110 is made of deformable material and can be placed in a urinal. The planar base pad 110 may be any two or three-dimensional shape. It is often designed to either fit the shape of the base of a urinal or to resemble other easily recognizable shapes and objects like flowers, hearts, etc.

Figure 15A:
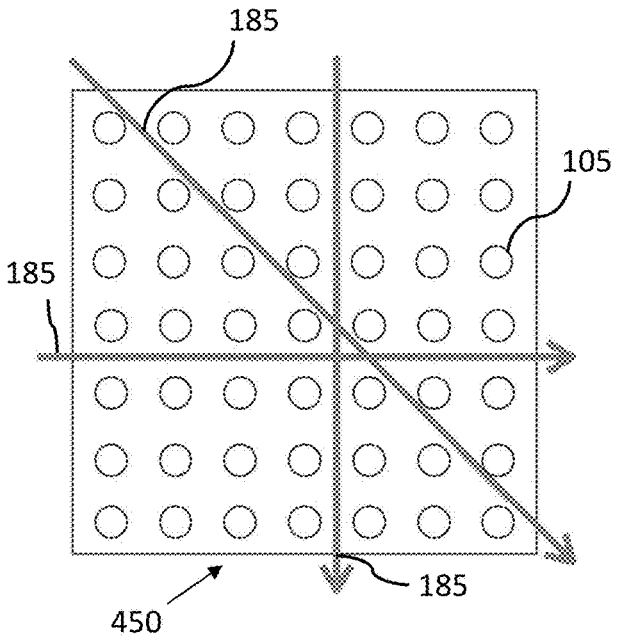
FIG. 15*a* is a depiction of free paths created through a Cartesian pillar arrangement.
Figure 15B:
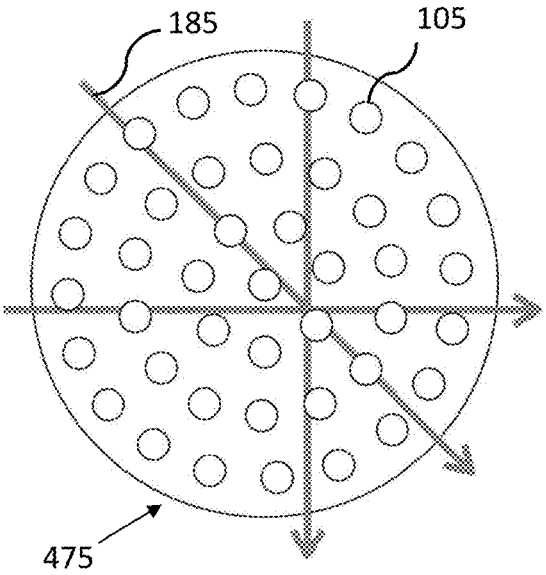
FIG. 15*b* is a depiction of free paths created through a polar pillar arrangement.
Figure 16A:
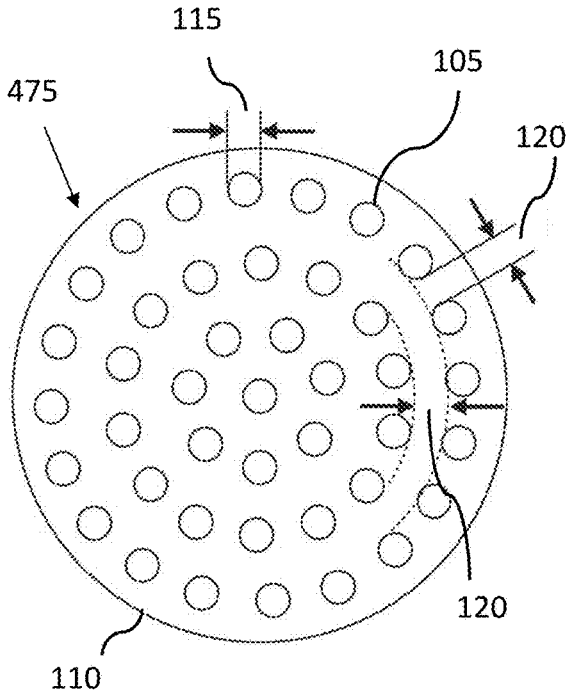
FIG. 16*a* is a top view of a circular splash prevention device.
Figure 16B:
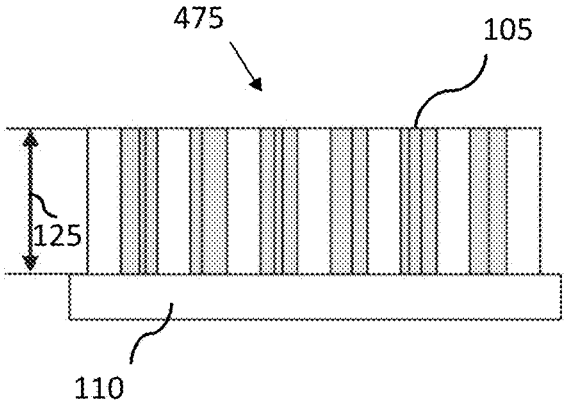
FIG. 16*b* is a side view of a circular splash prevention device.

In embodiments, a pillar array 105 extends from the planar base pad 110 which includes multiple pillars. The pillars 110 are made of a material that will bend when impinged upon by a stream of urine. FIG. 3*b* illustrates a non-Cartesian arrangement of the pillar array 105. Patterns such as this are designed to eliminate long open pathways that act as escape routes for satellite droplets 180. This concept is depicted in FIGS. 15*a* and 15*b*. FIG. 4 illustrates through an isometric elevation view the pillar array 105 and base pad 110 of the splash prevention device 300.

Figure 5:
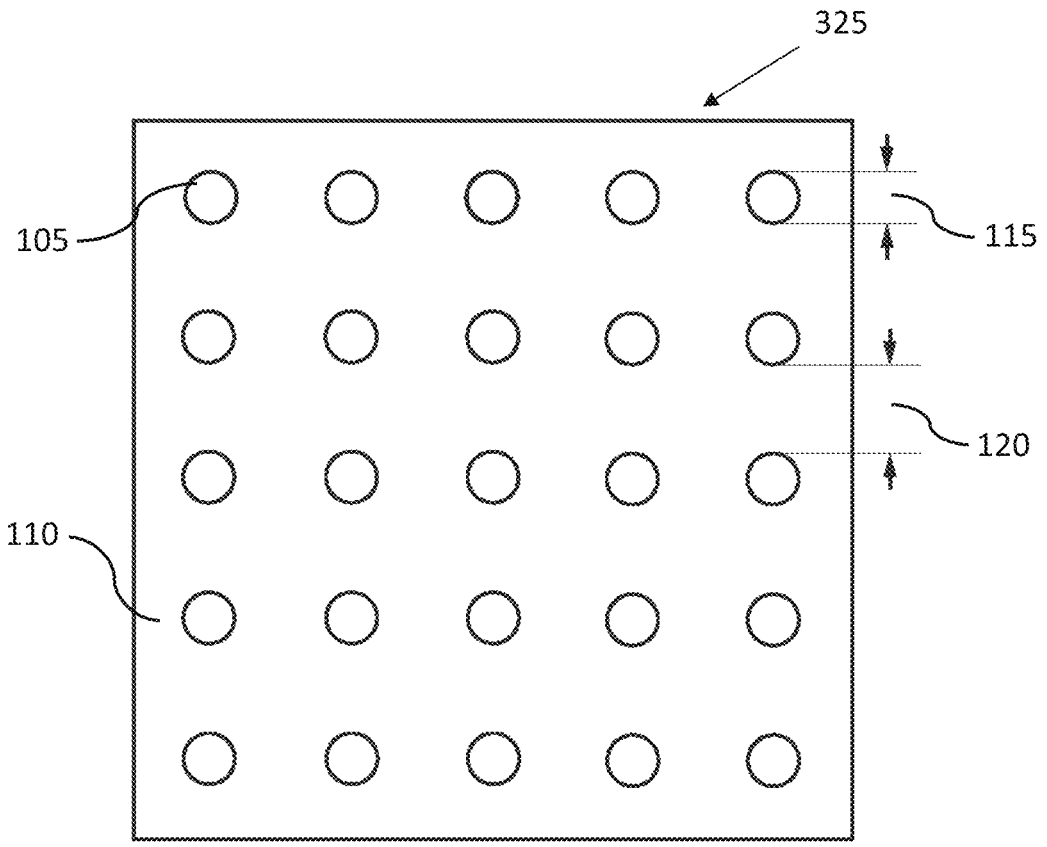
FIG. 5 is a top view of another splash prevention device.

FIG. 5 illustrates a top view of a splash prevention device 325 that each pillar may have a diameter 115 greater than 1 mm. Pillar diameters 115 of 1 mm or smaller fail to be much larger than satellite droplets 180 and thus are not very effective. Pillars are designed to have enough deformability to partially absorb the momentum of impinging droplets, yet still be sufficiently rigged to independently stand perpendicular to the base pad 110.

FIG. 5 also illustrate each pillar may have a spacing 120 between adjacent pillars greater than 1 mm. Spacing 120 between pillars that is too large creates open pathways for liquid to escape thus reducing the successful capture of satellite droplets 180. Spacing 120 that is too small leads to larger capillary forces which support higher standing water within the pillar array. This effectively decreases pillar height 125 resulting in more satellite droplets 180 escaping.

Figure 6:
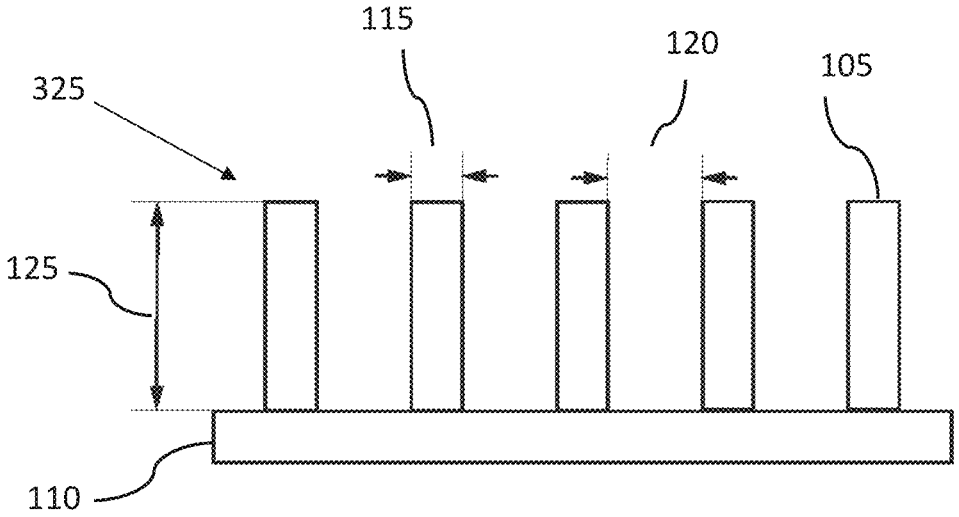
FIG. 6 is a side view of the splash prevention device of FIG. 5.

FIG. 6 illustrates a side view of a splash prevention device 325 where each pillar may have a height 125 greater than 1 mm. This is to maximize the capture of satellite droplets 180 created after the impact of a liquid on the pillar array 105 and base pad 110. Although FIG. 6 illustrates pillars of uniform diameter from top to bottom pillars may have varying thickness across its length. Additionally, pillars may have various shapes on the top of the pillar including but not limited to spheres semi-spheres, cones, pyramids, triangles, and other non-conventional shapes (not shown). The pillars 105 may also be connected to adjacent pillars through a thin membrane wall creating in the spaces between pillars open cells to capture and channel liquid.

Figure 7:
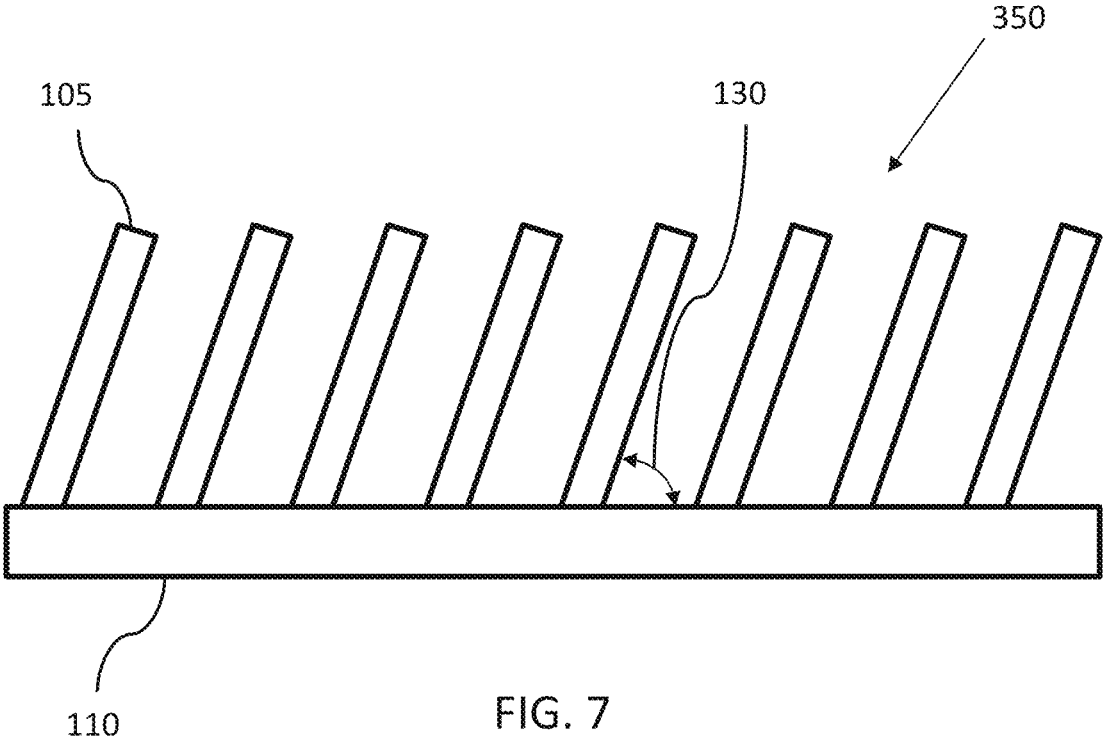
FIG. 7 is a side view of another splash prevention device.

FIG. 7 illustrates a side view of a splash prevention device 350 in which each pillar may be set at a non-perpendicular angle 130. Experiments were performed with the pillars in the pillar array 105 aligned parallel to the impinging liquid stream. This is ideal, however, in a urinal the urine stream is more often impacting at a non-perpendicular angle to the base pad 110. Setting the pillar array 105 at a non-perpendicular angle may align the pillars to become parallel with the impinging urine stream. However, it may be difficult for a user to impact the splash prevention device 350 at the proper angle with their urine stream parallel with the pillar array 105. Moreover, if the urinal pad 110 is placed in the urinal with an incorrect orientation (i.e. with the pillars facing any direction other than toward the user) the effective capture of satellite droplets 180 may be significantly reduced. The pillars of the pillar array 105 may be of non-uniform thickness, be of varying shapes, or have varying shapes at the pinnacle or tip.

Figure 8A:
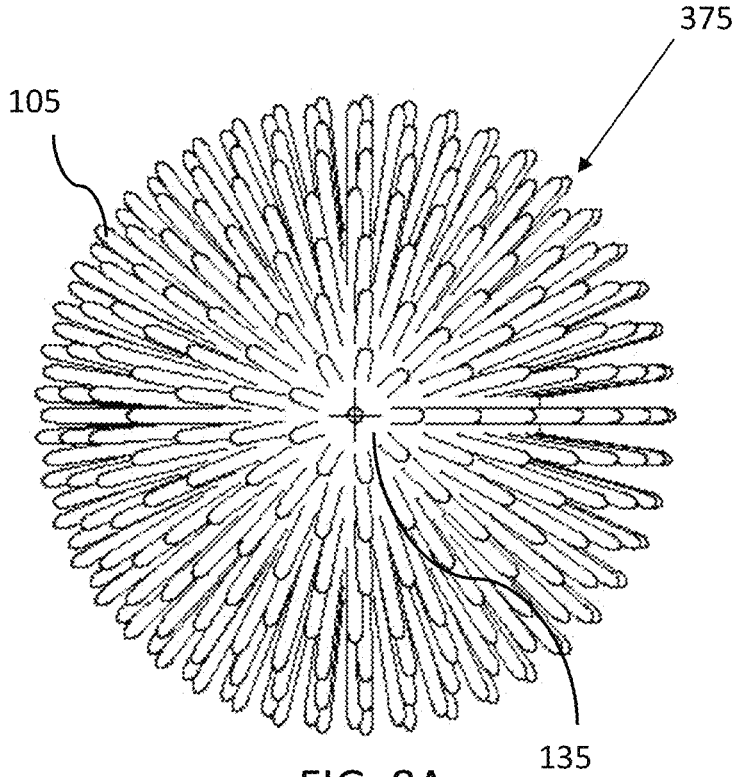
FIG. 8*a* is a top (or side or bottom) view a spherical splash prevention device.

FIG. 8*a* illustrates a splash prevention device 375 wherein the base pad 135 is spherical. This enables a person to place or remove the splash prevention device 375 from a urinal without any need to touch the urinal. The spherical pad 135 channels liquid to flow around and off the pad rather than forming pools.

Figure 8B:
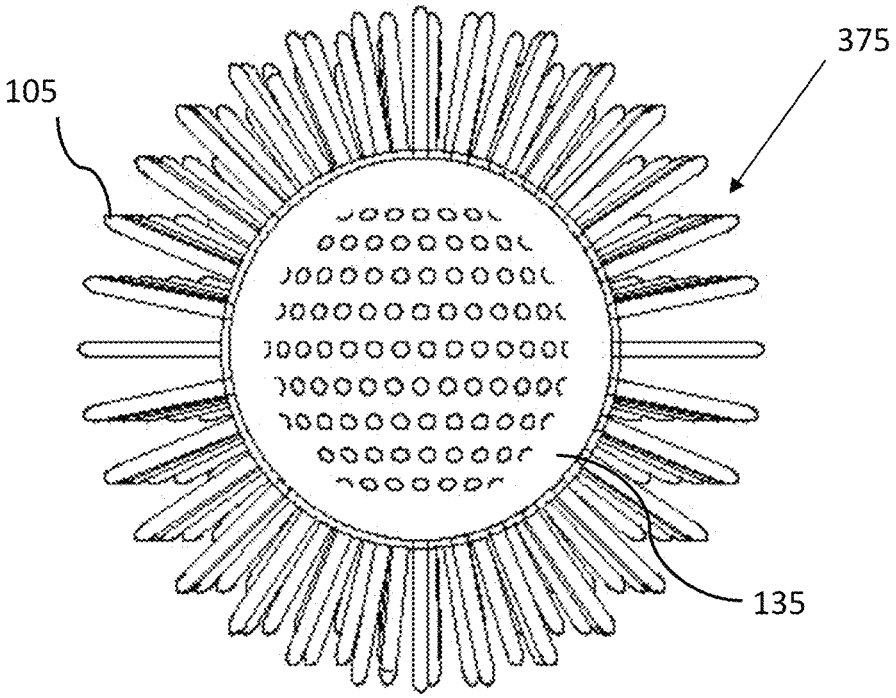
FIG. 8*b* is a cut-away view of the spherical splash prevention device shown in FIG. 8*a;*

FIG. 8*b* illustrates a cut-away isometric view of the splash prevention device 375, showing the hollow inside. A hollow center will save money on production costs and creates flexibility in the structure. This flexibility of a hollow spherical pad 135 can absorb the momentum of impinging liquid. Additionally, a base pad 135 may be designed to be a semi-sphere, as FIG. 8*b* appears to be.

Figure 9A:
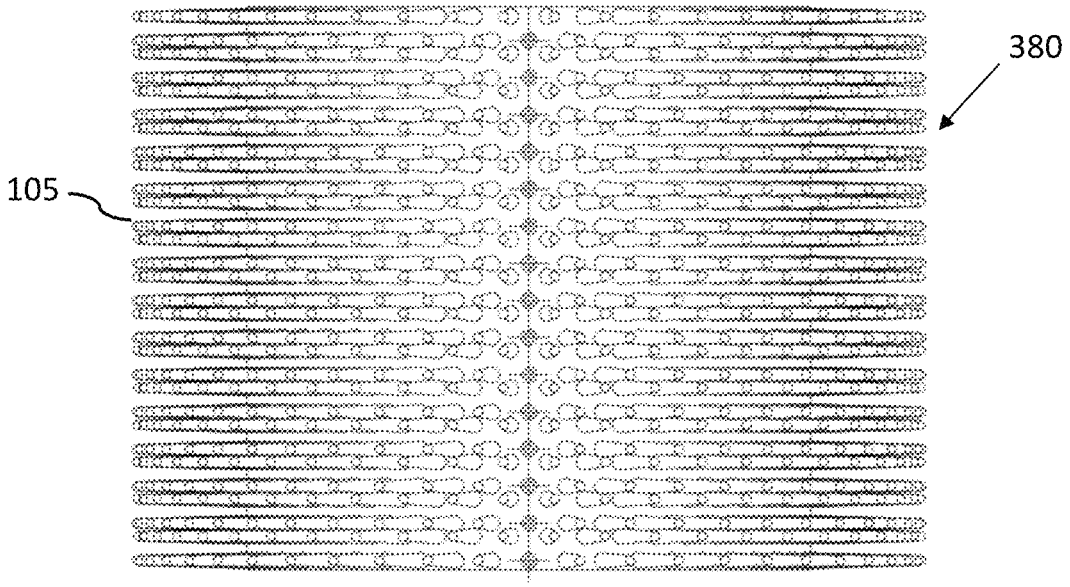
FIG. 9*a* is a side view of a cylindrical splash prevention device.
Figure 9B:
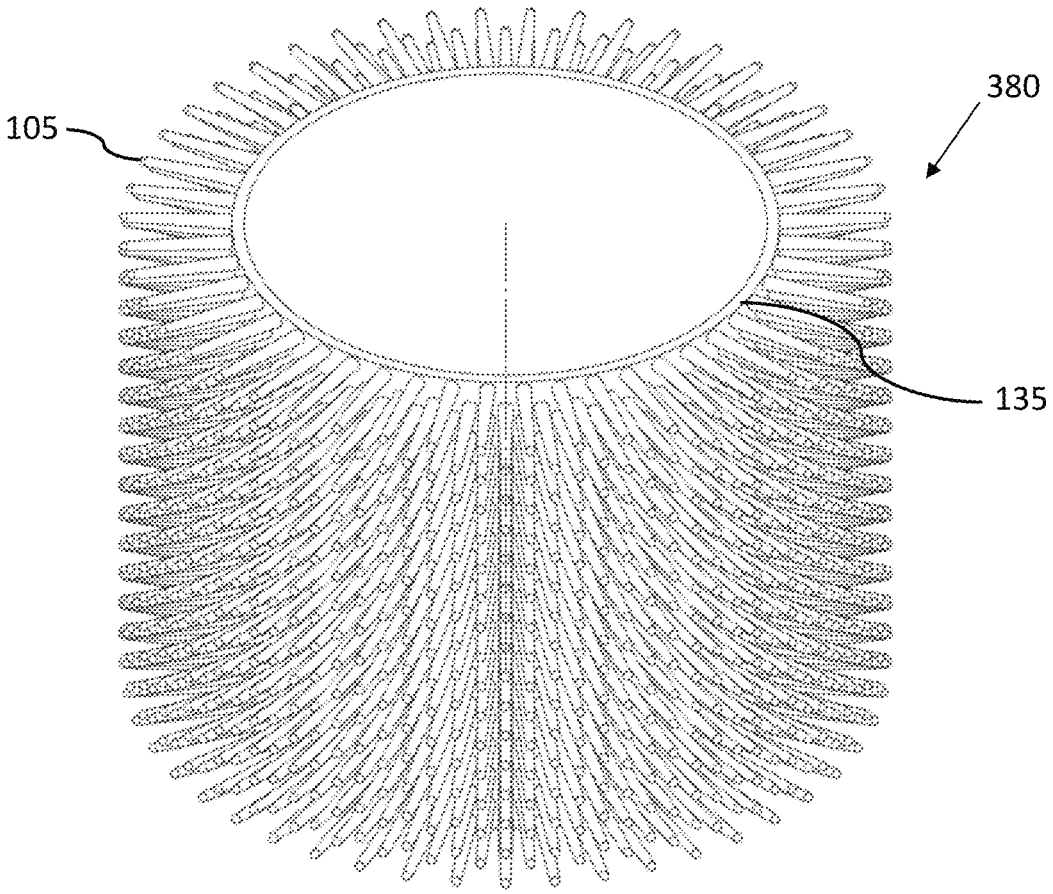
FIG. 9*b* is an isometric view of the cylindrical splash prevention device shown in FIG. 9A.

FIGS. 9*a* and 9*b* illustrate two views of a splash prevention device 380 wherein the base pad 135 is cylindrical. Like splash prevention device 375, splash prevention device 380 enables a person to place or remove the splash prevention device 380 from a urinal without any need to touch the urinal. The spherical pad 135 channels liquid to flow around and off the pad rather than forming pools. Additionally, splash prevention device 380 has a hollow cylindrical pad 135.

It will be appreciated that several of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

Test Results of Embodiments

Figure 11:
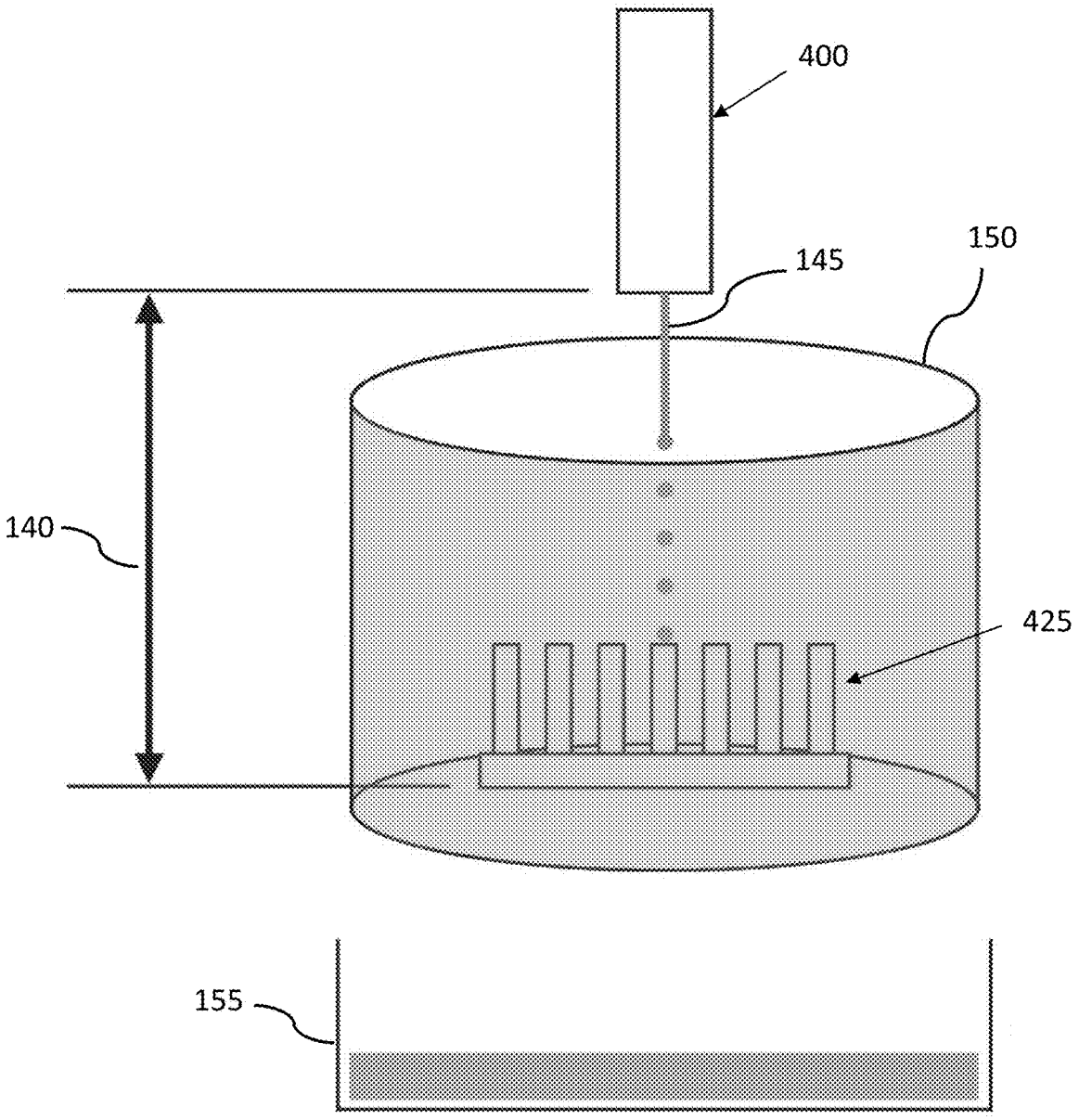
FIG. 11 is an illustration of the experimental set up.

The inventors of the embodiments disclosed herein evaluated the effectiveness of various configurations of cylindrical pillar arrays in an experimental setting which is described as follows. This experimental setup can be seen in FIG. 11.

Figure 10A:
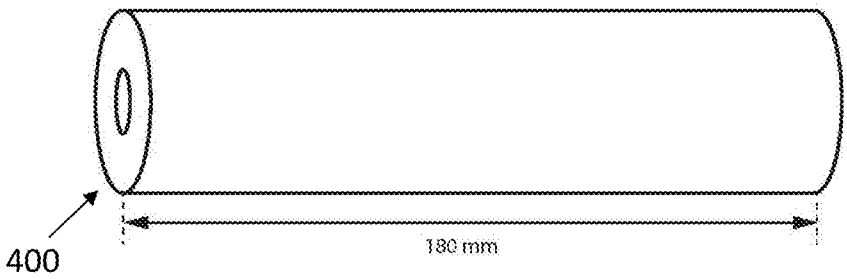
FIG. 10*a* is a side view of an artificial male urethra.
Figure 10B:
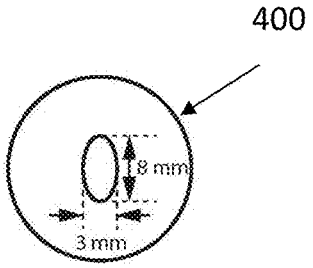
FIG. 10*b* is a front view of an artificial male urethra.

A simulated male urine stream 145 was created by attaching a small water reservoir (not shown) to the artificial male urethra 400, diagramed in FIGS. 10*a* and 10*b*, via plastic tubing (not shown). Sufficient pressure was supplied to the reservoir to produce the average male flow rate of 21 mL/s. The artificial male urine stream 145 produced by this configuration was used for all tests. Clean water, rather than actual urine was used since urine is composed primarily of water, and clean water does not propose any health concerns. Experiments were performed with water at approximately 21 degrees Celsius. The simulated male urine stream 145 flowed straight down onto experimental pads 425.

Experimental pads 425 consisted of a flat, square rigid base pad 110 supporting an array of rigid cylindrical pillars. The entire pillar array 105 and supporting base pad 110 were created on a 3D printer from ABS plastic. The pillar array 105 was characterized by three measurements consisting of: pillar height 125, pillar diameter 115, and spacing 120 between pillars. The parameters are measured in mm unless otherwise specified. The pillar array 105 and its associated dimensions are shown in FIGS. 5 and 6.

Experimental pads 425 were placed in a holder at a set height 140 below an artificial male urethra 400 producing a simulated urine stream 145. The set height 140 is half the height of an average man (3 ft. or 0.915 m). Water was allowed to flow at the average male flow rate of 21 mL/s for 10 seconds. This configuration allowed for the simulated male urine stream 145 to break into droplets ranging from 6-8 mm.

The experimental pads 425 were surrounded by a paper towel 150. The mass of the paper towel 150 was measured before and after each test to determine how much weight it had gained due to ejected satellite droplets 180. No appreciable change in wetted paper towel mass was observed as a function of time. This rules out measurement discrepancy due to evaporation. High speed footage of small droplets impacting the paper towel verify that droplets were observed to immediately absorb into the towel such that they did not ricochet off the towel.

Residual water ran into a basin 155 below the experiment. This was used to determine what percentage of the total released mass was ejected onto the paper towel. The experimental pads 425 were saturated with water before each test for consistency. Experiments were carried out to determine the effects of pillar spacing 120, diameter 115, and height 125 on ejected water droplets.

Figure 12:
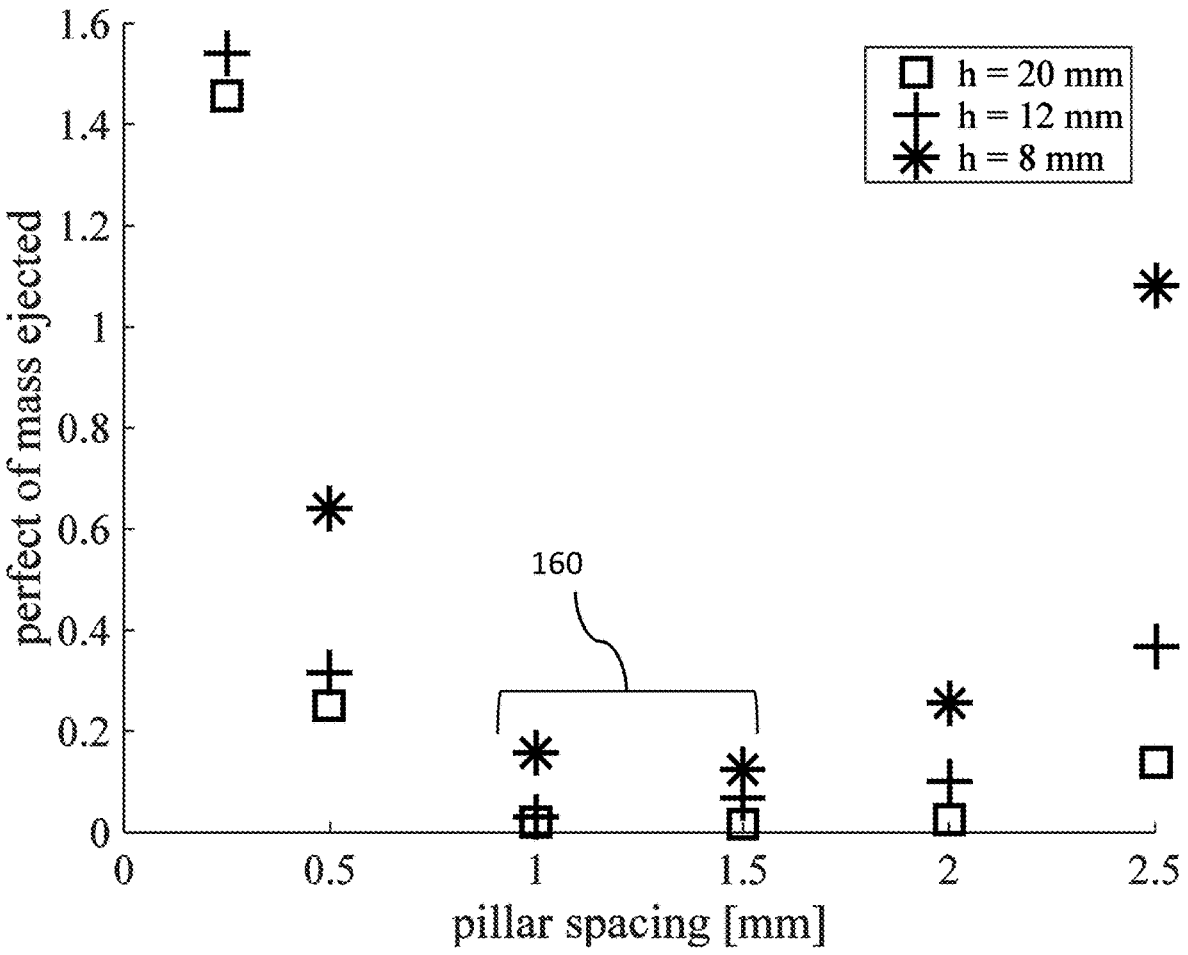
FIG. 12 is a graph of experiment results testing varying pillar spacing.

First, the inventors tested the effect of pillar spacing 120 on ejected mass. The experimental results are presented in FIG. 12. In this set of experiments pillar diameter 115 was held at 1 mm. From FIG. 12 we can see that there is an optimal configuration 160 for pillar spacing 120. Intuitively one would expect as the pillar spacing 120 gets smaller the increased density would lead to more droplet-pillar collisions and thus less ejected satellite droplets 180. However, decreased spacing 120 leads to larger capillary forces which support higher standing water within the pillar array. This effectively decreases pillar height 125 resulting in more satellite droplets 180 escaping. The inventors discovered an optimal configuration 160 for the pillar spacing 120 roughly between 1-2 mm. This optimal configuration 160 allows the pillars to be as close as possible without creating high standing water due to capillary forces.

Figure 13:
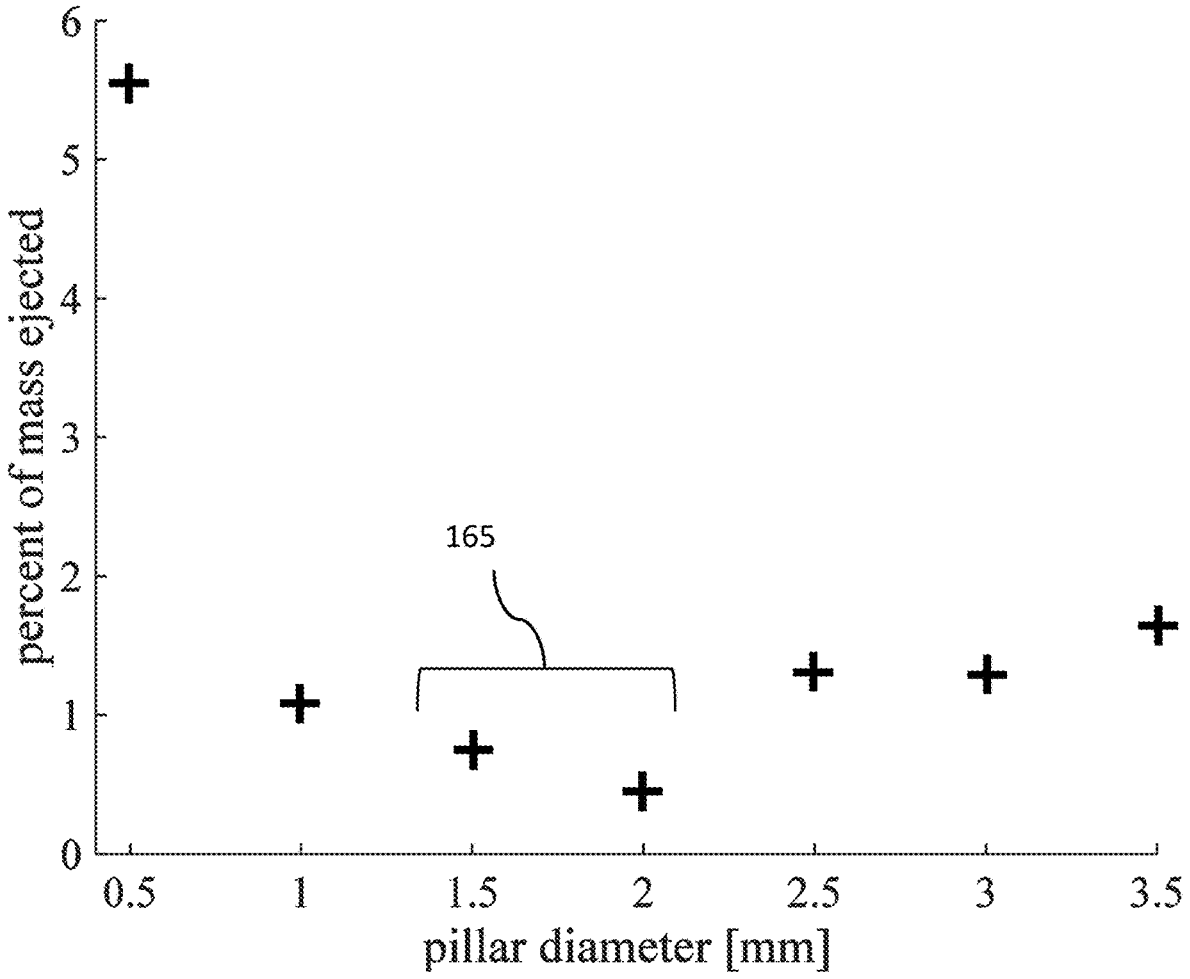
FIG. 13 is a graph of experiment results testing varying pillar diameter.

Next, the inventors investigated the effect of pillar diameter 115 on satellite droplet 180 capture. The experimental results are presented in FIG. 13. In this set of experiments height 125 was held at 8 mm and spacing 120 was held at 2.5 mm. It is clear that pillar diameter 115 does not have pronounced effect on ejected mass, though diameters 115 between 1.5 and 2 mm seem to be the optimal diameter range 165. Pillar diameters 115 below 1 mm appear to be extremely unhelpful at reducing splash. This could be because pillar diameter 115 is approaching the size of the satellite droplets 180.

Figure 14:
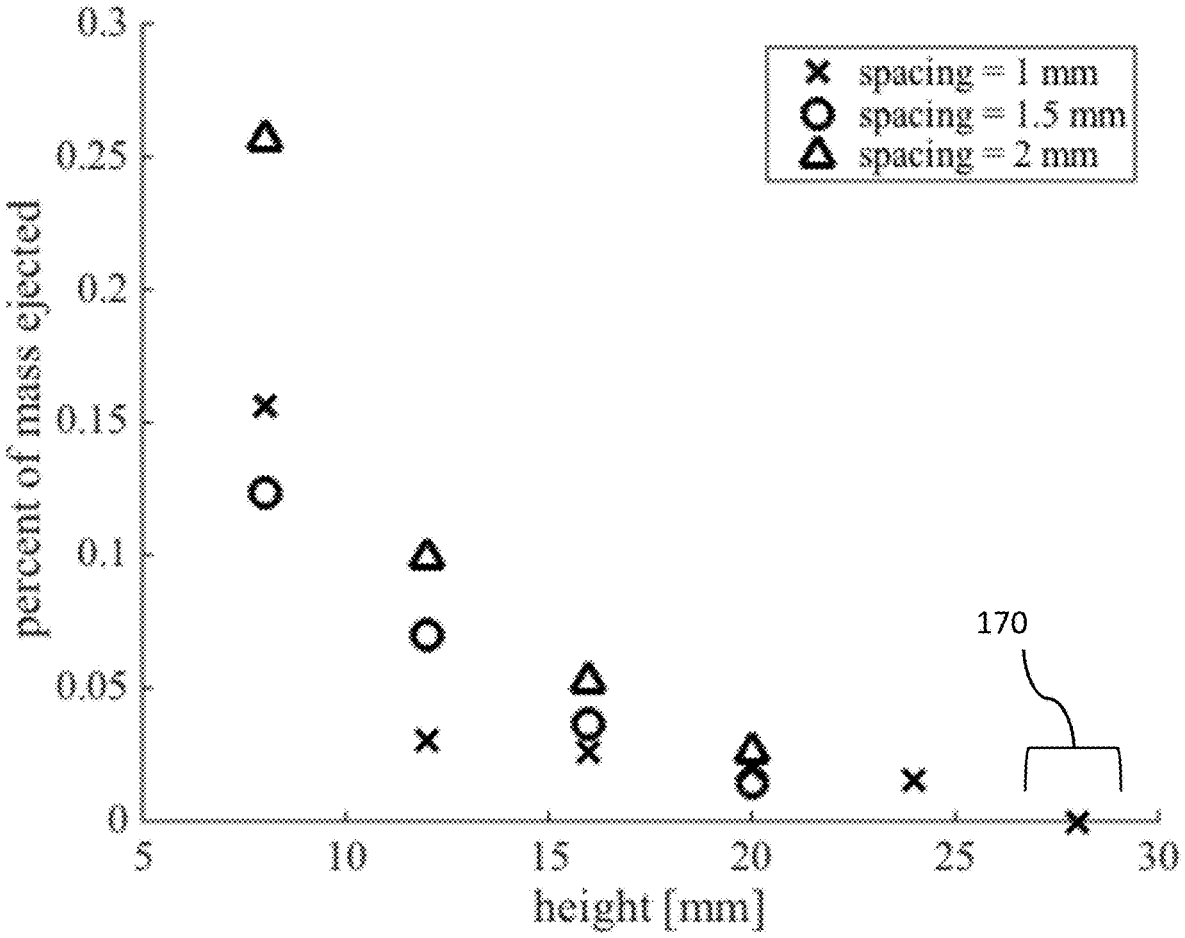
FIG. 14 is a graph of experiment results testing varying pillar height.

The inventors then investigated the effect of pillar height 125 on the amount of satellite droplets 180 ejected. The experimental results are presented in FIG. 14. In this set of experiments, spacing 120 was held at 1.5 mm and pillar diameter 115 was held at 1 mm. FIG. 14 shows that higher pillars are more effective at reducing splashing, with complete reduction 170 occurring with a pillar height 125 of approximately 28 mm. The amount of satellite droplets 180 escaping could be reduced further using pillars with larger diameters 115 and possibly by modifying pillar spacing 120. Also, it should be mentioned that this plot does not indicate that no satellite droplets 180 escaped at the point of complete reduction 170; rather a measurable amount of satellite droplets 180 was not propelled as far as the perimeter formed by the paper towel 150.

FIGS. 15*a* and 15*b* illustrate a flaw in using a Cartesian coordinate system to arrange pillars. The Cartesian coordinate system employed to determine the positions of the pillars in the square pad 450 in FIG. 15*a* naturally create straight paths 185 through the pillar array 105. This is not ideal because satellite droplets 180 typically travel in near-straight paths. This means that an impinging droplet can create satellite droplets 180 which will be uninhibited when traveling along these straight paths 185. This may seem unlikely, but when one considers the thousands of droplets that can impact during a single urination, each creating tens of ejected droplets, the odds of escaping water droplets are actually guaranteed. The circular pad 475 in FIG. 15*b*, however, has pillars 105 whose positions are defined by a polar coordinate system. This pattern naturally produces an arrangement that does not allow straight paths 185 for satellite droplets 180 to traverse. This polar configuration provides the advantages of random positions with the benefits of consistent coordinates.

Figure 17:
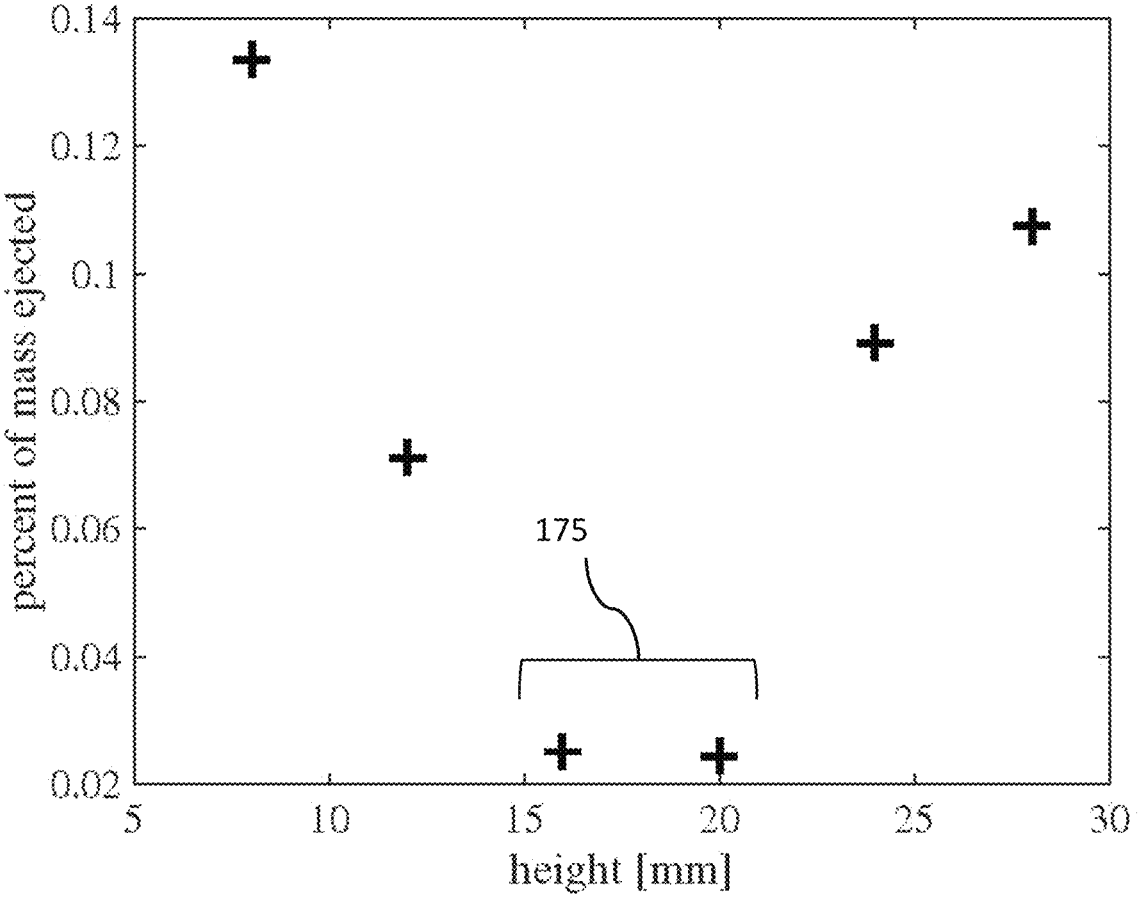
FIG. 17 is a graph of experiment results testing varying pillar height of deformable pillars.

The inventors performed a final set of experiments to discover the specifications of an absolute ideal splash preventions apparatus. Circular pads 475 were produced with a polar coordinate system and from deformable material. Additionally, they were made with a spacing 120 of 1.5 mm and a diameter 115 of 2 mm, the ideal parameters observed with rigid pillar arrays. A set of these new pads were created with varying heights and tested in the same manner described previously. The results from this experiment are displayed in FIG. 17. One would expect that the number escaping satellite droplets 180 would continuously decrease as height 125 increases, however, this is not the case. The amount of escaping satellite droplets 180 first decreases, then begins to increase. This is likely because the deformable pillars begin to sag with increasing height 125 and thus detract from the optimal range for pillar spacing 160. However, it should be noted that around a height 125 of 18 mm, 0.02% ejected mass was measured. This is on the order of the error of the scale. In other words, the mass ejected here is nearly negligible (notice the graph ranges differ for each plot). Thus, it can be determined that the ideal specifications for deformable pillar arrays with polar coordinates are a height range 175 between 15 mm and 21 mm, 18 mm being the most effective, a pillar spacing 120 of 1.5 mm, and a pillar diameter 115 of 2 mm.

What is claimed is:

1. A splash prevention device comprising, a planar base pad;

a pillar array extending from the planar base pad and configured to limit splash back of droplets impacting the planar base pad, the pillar array comprising multiple pillars, wherein each pillar has:

a thickness greater than 1.5 mm in diameter and less than 2.5 mm in diameter; and a height greater than 15 mm and less than 22 mm;

wherein:

a spacing between adjacent pillars is greater than 1 mm and less than 2 mm;

the pillars in the pillar array are arranged to prevent a straight path of travel for the droplets through the pillar array; and the pillar array comprises a deformable material.

2. The splash prevention device of claim 1, wherein the pillars are coated in a surfactant configured to create foam bubbles when liquid impinges thereon.

3. The splash prevention device of claim 1, wherein the pillars of the pillar array extend from the planar base at a non-perpendicular angle.

4. The splash prevention device of claim 1, wherein the planar base is a spherical base.

5. The splash prevention device of claim 1, wherein the pillar array is arranged to provide a mean free path for the droplets that is parallel to the base pad and between pillars that is less than 10 mm.

6. A splash preventing apparatus comprising, a spherical base pad;

a pillar array extending from the spherical base pad and configured to limit splash back of droplets impacting the spherical base pad, the pillar array comprising multiple pillars, wherein each pillar has:

a thickness greater than 1.5 mm in diameter and less than 2.5 mm in diameter; and a height greater than 15 mm and less than 22 mm;

wherein a spacing between adjacent pillars is greater than 1 mm and less than 2 mm.

7. A splash prevention apparatus comprising:

a cylindrical base pad;

a pillar array extending from the cylindrical base pad and configured to limit splash back of droplets impacting the cylindrical base pad, the pillar array comprising multiple pillars, wherein each pillar has:

a thickness greater than 1.5 mm in diameter and less than 2.5 mm in diameter; and a height greater than 15 mm and less than 22 mm;

wherein a spacing between adjacent pillars is greater than 1 mm and less than 2 mm.

8. A splash prevention device comprising, a planar base pad;

a pillar array extending from the planar base pad and configured to limit splash back of droplets impacting the planar base pad, the pillar array comprising multiple pillars, wherein each pillar has:

a thickness greater than 1.5 and less than 2.5 mm in diameter; and a height greater than 15 mm and less than 22 mm;

wherein:

a spacing between adjacent pillars is greater than 1 mm and less than 2 mm;

the pillars in the pillar array are arranged to prevent a straight path of travel for the droplets through the pillar array.

9. The splash prevention device of claim 8, wherein the pillars are coated in a surfactant configured to create foam bubbles when liquid impinges thereon.

10. The splash prevention device of claim 8, wherein the pillar array comprises a rigid material.

11. The splash prevention device of claim 8, wherein the pillar array comprises a deformable material.

12. The splash prevention device of claim 8, wherein the pillar array is arranged to provide a mean free linear path for the droplets that is parallel to the base pad and between the pillars that is less than 10 mm.

* * * * *